United States Patent [19]

Petersen

[11] Patent Number: 4,489,895

[45] Date of Patent: Dec. 25, 1984

[54] VERTICAL ROLLER MILLS

[75] Inventor: Luis Petersen, Copenhagen, Denmark

[73] Assignee: F. L. Smidth & Co. A/S, Denmark

[21] Appl. No.: 475,297

[22] Filed: Mar. 14, 1983

[30] Foreign Application Priority Data

Apr. 13, 1982 [GB] United Kingdom ..... 8210767

[51] Int. Cl.[3] ..... B02C 23/26

[52] U.S. Cl. ..... 241/19; 241/24; 241/29; 241/57; 241/119; 241/152 A

[58] Field of Search ..... 241/80, 97, 24, 52, 241/53, 166, 167, 112, 57, 117–122, 19, 29, 152 A

[56] References Cited

U.S. PATENT DOCUMENTS 2,818,219 12/1957 Straight ..... 241/119
3,556,419 1/1971 Frangquist ..... 241/119 X
4,385,730 5/1983 Kartman ..... 241/57

FOREIGN PATENT DOCUMENTS 27681 4/1981 European Pat. Off. .
919879 11/1954 Fed. Rep. of Germany ..... 241/167

*Primary Examiner*—Mark Rosenbaum
*Attorney, Agent, or Firm*—Brumbaugh, Graves, Donohue & Raymond

[57] ABSTRACT

A vertical roller mill has a rotary grinding table (1), grinding rollers (3) and a nozzle ring (13) surrounding the table for providing an air stream to entrain ground material. Downstream of each roller is a scraper (20) with a nozzle for directing a blast of air onto the crushed material leaving the roller to break up the material so that finer fractions pass into the conveying air stream and coarser fractions are carried on the table to the next roller.

3 Claims, 3 Drawing Figures

VERTICAL ROLLER MILLS

The invention relates to vertical roller mills of the kind, hereinafter referred to as of the kind described, comprising a mill housing surrounding a grinding table which rotates about a vertical axis, at least one grinding roller rotating about a stationary axis and urged against a material layer on the grinding table, and a nozzle ring encircling the table for discharging air to convey away, and possibly also dry, ground material.

In known mills of the above kind, material, having been crushed on the grinding table, moves by centrifugal force due to the rotation of the grinding table, into the conveying air stream from the nozzle ring. The air sucked into and through the nozzle ring causes the material to be entrained and carried upwards in the mill housing above the grinding table, finer fractions of the material passing into a stationary separator at the top of the mill, or out of the mill into a separate separator, while coarser fractions fall down again onto the grinding table. In the separator the material entrained by the conveying air is sorted into a further coarse fraction which is returned for renewed grinding in the mill, and a fine fraction which is led away for further treatment or storing.

The crushed material passing from the grinding table towards the nozzle ring consists of both fine and coarse material fractions, often closely cohering in the form of large or small cakes which call for a comparatively powerful flow of air up through the nozzle ring in order to be entrained, whirled about and separated. This requisite, powerful flow of air through the nozzle ring results in comparatively large air pressure drop over the mill.

To facilitate the conveying air from the nozzle ring blowing through the material and entraining the fine fractions for storing in the aforementioned separator, it is known to position after each roller, a rake which is oriented downwardly towards the grinding table, for raking and breaking up the freshly crushed material layer.

It is also known from our published European Patent application No. 0027681 for air from the nozzle ring to be discharged horizontally across the grinding table but this is to avoid vertically facing nozzle ring openings into which lumps of material might fall and does nothing significantly to disturb the layer of material on the grinding table.

It is the object of the invention to further improve the classification of the crushed material, and in accordance with the invention, in a method of classifying ground material during operation of a vertical roller mill of the kind described, after having been crushed by the grinding roller material layer on the grinding table is at least partly lifted from the table by a scraper and then subjected to a blast of air which stirs and breaks up the crushed material and causes finer fractions of the material to be entrained by the conveying air stream from the nozzle ring, while coarser fractions of the material fall back onto the table for further grinding.

In this way, there are achieved not only a breaking up and whirling about of the crushed material, but also a first sorting on the grinding table of the material into a fine fraction which is blown away from the grinding table and a coarse fraction which falls down on the grinding table again for renewed grinding. By removing already ground particles from the grinding table before the next crushing by a roller a lower power consumption for the grinding is achieved. Furthermore, a lower pressure drop of the conveying air passing through the nozzle ring in the mill is obtained as this conveying air is only used for transportation and possibly drying purposes, and not for breaking up and sorting the crushed material passing to the nozzle ring.

In addition, the classifying effect of the powerful blast of air against the crushed material layer results in a more homogeneous material layer on the grinding path of the grinding table before being crushed again by a roller, which again results in reduced torque variations of grinding table and grinding rollers.

The invention also includes a vertical roller mill of the kind described for carrying out the new method, wherein a scraper and a separate nozzle are positioned downstream, as considered in the direction of rotation of the table, of the roller, the separate nozzle being oriented so as to direct a blast of air, in use, against the crushed material lifted from the table by the scraper.

The separate nozzle may comprise a nozzle opening in the scraper which is hollow and which is mounted immediately above, and extending transversely to, a grinding path on the table, the scraper being arranged to be connected via a pipe to a source of compressed air.

By means of the scraper the crushed material is broken up and moves to the nozzle opening of the scraper whereby the material is whirled up by the air from the nozzle opening.

The invention is now described in more detail by way of an example of a mill according to the invention and with reference to the accompanying drawings, in which.

Figure 1:
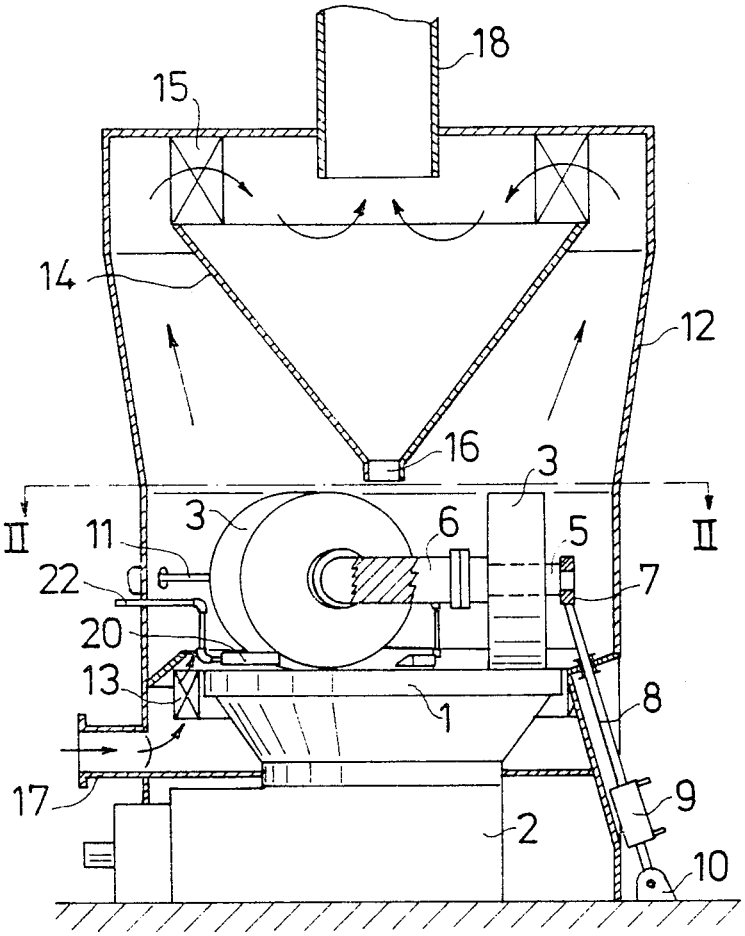
FIG. 1 is a diagrammatical elevation of part of the mill partly in vertical section.

A grinding table 1 is shown rotatable about a vertical axis, and supported and driven by a unit 2. Resting against and rolling on the grinding table 1 are grinding rollers 3, in this example three rollers, for grinding a layer of material 4 (FIG. 3) on the grinding table 1. Each roller 3 is mounted on a fixed shaft 5 which, together with the shafts of the other rollers, is attached to a common central frame 6.

On the outer end of each shaft 5 is pivotally mounted a bracket 7 to which is attached a drawbar 8 so as to force the roller down against the grinding table 1 by means, for instance, of an hydraulic cylinder 9 pivotally retained in a bracket 10 which is anchored in the mill foundation.

Figure 2:
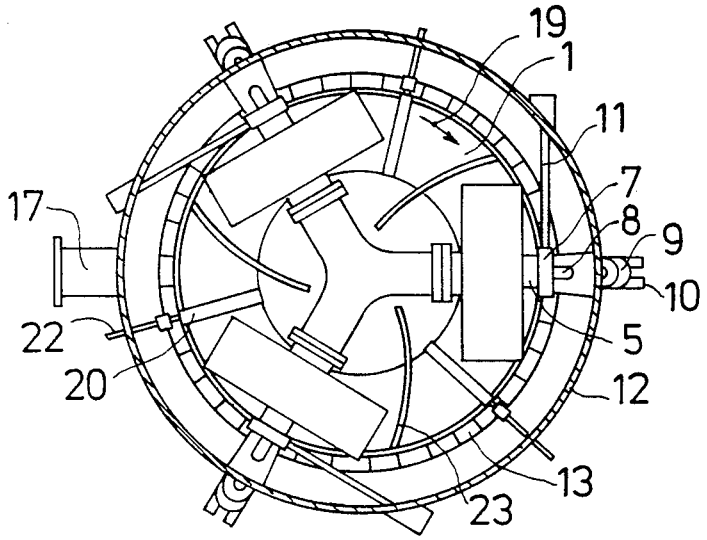
FIG. 2 is a section taken on the line II—II in FIG. 1.

The shafts 5 are prevented from moving in the direction of rotation of the grinding table, for example as shown in FIG. 2, by means of horizontal drawbars 11 which at one end are attached to the brackets 7 and at the other end are connected to the mill housing 12.

A nozzle ring 13 encircles the grinding table 1, and above the table 1 and the frame 6 is mounted a stationary separator 14 having, at its top, an inlet for suspended material in the form of an adjustable louvre 15 and, at its bottom, an outlet 16 for coarse material separated in the separator.

Conveying, and possible drying, air to the mill is fed at the bottom of the housing 12 through an air supply pipe 17 into a chamber below the grinding table 1 and the nozzle ring 13. Spent mill air with fine material, i.e.

material sufficiently ground in the mill, is discharged from the mill through a material-air outlet 18 at the top of the separator 14.

Seen in the direction of rotation 19 (FIGS. 2 and 3) of the grinding table, a scraper 20 is mounted immediately after each roller 3, closely above and transversely to the grinding path of the grinding table 1. In the example shown, the scraper is hollow and has a nozzle slit 21. Compressed air is led to the scraper 20 through a pipe 22.

The mill operates in the following way:

Material to be ground is supplied from outside and passed through a duct (not shown) down towards the centre of the grinding table 1 and moves, due to the rotation of the grinding table, outwards into the path of the grinding rollers 3 where it is ground, and hence to the nozzle ring 13.

Conveying and drying air from the lower part of the mill flows up through the nozzle ring 13, entrains the ground material and conveys it up through the mill, as indicated by arrows (FIG. 1) and into the separator 14 through the louvre 15.

The coarse fraction separated in the separator 14 moves down through the hopper-shaped part of the separator, towards the separator outlet 16 and hence onto the grinding table for renewed grinding together with freshly supplied, unground material.

The fine fraction separated in the separator 14 is entrained by the conveying air and discharged at the top of the mill through the air outlet 18.

In the previously known mills the conveying air was utilized both to blow away and break up the cakes of material which had passed from the grinding table 1 above the nozzle ring 13. For this purpose a comparatively powerful flow of air up through the nozzle ring 13 was necessary, which led to a rather large pressure drop over the mill.

Figure 3:
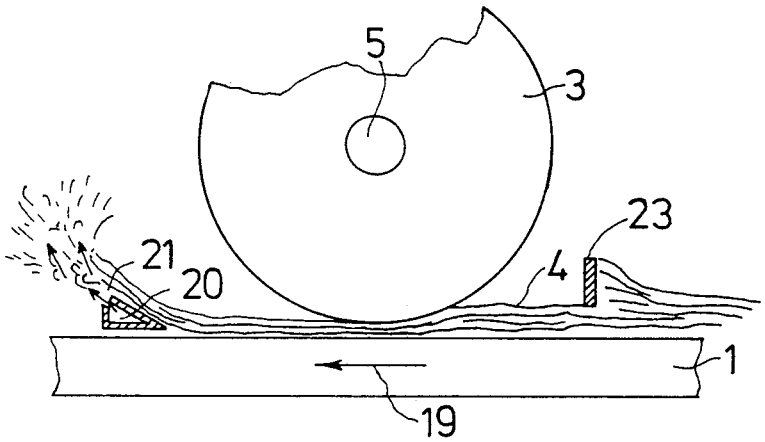
FIG. 3 is a very simplified side elevation of part of the grinding table of the mill and a grinding roller.

As illustrated in FIG. 3, a material layer 4, freshly crushed by the roller 3, is loosened from the grinding path of the grinding table 1 by means of the scraper, and the broken up material layer slides over the scraper and is hit at the top rear edge of the scraper by a powerful jet of air, flowing out of the scraper through the nozzle opening 21. This powerful jet of air whirls up the broken material and classifies it in such a way that finer particles are blown into the mill where they are entrained by the conveying air passing through the nozzle ring 13 while coarser particles fall down again on the grinding table for renewed crushing by the subsequent grinding roller 3.

Furthermore, as indicated in FIGS. 2 and 3 there may be a return scraper 23 in front of each roller 3, which guides material from the centre of the grinding table 1 to the grinding path, and, as indicated in FIG. 3, smoothes the material layer before it is crushed by a grinding roller 3.

I claim:

1. A vertical roller mill comprising a mill housing surrounding a grinding table, means for rotating said grinding table about a vertical axis, at least one grinding roller rotating about a stationary axis and urged, in use, against a material layer on said grinding table to form a crushed material layer, and a nozzle ring encircling said grinding table for discharging, in use, air to convey away ground material; at least one scraper and a separate nozzle both positioned downstream, as considered in the direction of rotation of said grinding table, of said roller; said scraper being adapted to lift said crushed material layer from said grinding table; said separate nozzle being oriented and adapted so as to direct a blast of air, in use, against said crushed material layer lifted from said grinding table by said scraper.

2. A mill according to claim 1, wherein said scraper is hollow and is mounted immediately above, and extending transversely to, a grinding path on said grinding table; said separate nozzle comprising a nozzle opening in said scraper and connecting means comprising an air pipe leading to said scraper.

3. A method of grinding and classifying on a vertical roller mill comprising the steps of:

(a) providing a grinding table rotatable about a vertical axis and at least one grinding roller rotatable about a stationary axis such that the peripheral surface of the grinding roller is urged against a material layer when said material layer is placed upon said grinding table;

(b) placing a material layer on said grinding table and grinding said layer between said table and said at least one grinding roller;

(c) at least partially lifting said material layer from said grinding table after grinding by means of at least one scraper placed adjacent said grinding table in the path of the ground layer;

(d) subjecting said layer to a blast of air at least partially from at least one air nozzle located in said at least one scraper while said layer is at least partially lifted from the grinding table by said scraper such that the at least partially lifted layer is stirred and broken up by said blast of air; and (e) causing the finer fractions of the stirred and broken material to be entrained by said blast of air and thereby conveyed away from said grinding table while the coarser fractions of the stirred and broken material are allowed to fall back on the grinding table for further grinding.

* * * * *